US006658218B2

(12) United States Patent
Krolczyk et al.

(10) Patent No.: US 6,658,218 B2
(45) Date of Patent: Dec. 2, 2003

(54) ILLUMINATED COMPONENTS FOR GUIDING MAINTENANCE AND REPAIR SEQUENCE

(75) Inventors: Marc J. Krolczyk, Rochester, NY (US); Ken Hayward, Brockport, NY (US); Jeffrey M. Zielinski, Highpoint, NC (US); William Skillern, Rochester, NY (US); Kenneth J. Rieck, Victor, NY (US)

(73) Assignee: Xerox Corporation, Stamford, CT (US)

( * ) Notice: Subject to any disclaimer, the term of this patent is extended or adjusted under 35 U.S.C. 154(b) by 12 days.

(21) Appl. No.: 10/029,312

(22) Filed: Dec. 28, 2001

(65) Prior Publication Data

US 2003/0123886 A1 Jul. 3, 2003

(51) Int. Cl.[7] ..... G03G 15/00
(52) U.S. Cl. ..... 399/16; 399/18; 399/21
(58) Field of Search ..... 399/9, 11, 16, 399/18, 21, 42

(56) References Cited

U.S. PATENT DOCUMENTS

| | | | | | |
|---|---|---|---|---|---|
| 4,497,569 | A | | 2/1985 | Booth, Sr. | 399/20 |
| 4,572,652 | A | * | 2/1986 | Tada et al. | 399/81 |
| 4,617,661 | A | * | 10/1986 | Futaki et al. | 399/9 |
| 4,627,711 | A | | 12/1986 | Schron | 399/20 |
| 5,790,374 | A | * | 8/1998 | Wong | 361/685 |
| 6,314,249 | B1 | * | 11/2001 | Lay et al. | 399/11 |

* cited by examiner

*Primary Examiner*—Hoan Tran
(74) *Attorney, Agent, or Firm*—Richard Spooner

(57) ABSTRACT

An apparatus and method for guiding human operators through a sequence of maintenance and repair tasks such as the removal of paper jams in complex reprographic equipment. The invention comprises the placement of human interpretable indicators in locations corresponding to various operations to be performed by an operator and then activating such indicators in sequence when sensors and a control algorithm confirm that operations preceding the operation in the sequence are completed.

29 Claims, 7 Drawing Sheets

ILLUMINATED COMPONENTS FOR GUIDING MAINTENANCE AND REPAIR SEQUENCE

BACKGROUND OF THE INVENTION

The present invention relates to the field of maintenance and repair sequences for complicated equipment. More particularly, the present invention relates to apparatus and method for guiding human operators through a sequence of tasks such as removing of paper jams in complex production reprographic equipment. While this invention will be illustrated in relation to the task of removing such paper jams, it is believed that the apparatus and methods of the present invention have wide applicability, particularly to routine maintenance or repair operations to be performed by human operators that have not been specially trained and for such operations when many variables combine to vary the sequence from one operation to the next.

Although the art of avoiding paper jams has progressed steadily since reprographic printing systems were commercialized, paper jams remain an unfortunate occasional occurrence. Much work has occurred in preventing, diagnosing, and ameliorating the effects of paper jams. For instance, it has become common for printing systems to include a series of sensors designed to detect the location where a paper jam occurs. Since, as will be explained more thoroughly below, many sheets are typically being processed within a large printer simultaneously, some sheets will usually have progressed in the paper path beyond the point of the jam while others will have left the input copy paper bin but not yet have been processed by the system up to the point of the jammed sheet. In U.S. Pat. No. 4,627,711 issued to Schron and U.S. Pat. No. 4,497,569 issued to Booth, a controller for the print system detects the existence of a paper jam and its location. The controller then deduces which sheets in the system may continued to be processed through completion and which need to be halted in situ because of interference by the jam. Such commands are then given, and some sheets within the body of the printer are processed to completion while others remain stationary within the printer. Also, typically, in such systems and in other modern printers with recirculating feeders, the controller analyzes the condition of sheets halted by paper jams and, after the jams have been cleared, directs the operator through the user Interface (UI) to reassemble the sheets to be copied in a specified order in order to resume printing or copying of the job. An operator may also cancel the jammed job and reassemble the sheets in any order the operator prefers in order to complete the job.

All of these features of modern reprographic systems indicate the high degree of control and sophistication now enabled by microprocessors and sensors operating in conjunction with sophisticated control algorithms. These features also indicate that different types of paper jams occurring in different locations require different solutions. For an operator, this often means that different parts of a machine must be opened, and sheets in different locations and orientations must be removed. In many machines, the UI instructs the operator which cabinet doors must be opened and/or components like finishers must be separated. In relatively simple printing systems, an operator that opens a cabinet as instructed for a paper jam can easily observe various levers and handles which need to be moved in order to observe or reach jammed or halted sheets in the printer. In many printers such as those designed and marketed by Xerox Corporation, these doors and handles are colored a unique pale green and are often numbered. The purpose of the numbering system is to guide the operator through the various steps required to access all portions of the paper path within the relevant cabinet.

Higher speed printing systems are often more complex and usually contain longer paper paths. Since, as described above, different portions of a sheet path may be automatically cleared depending upon where the paper jam occurred, different portions of a complex printing machine may need to be opened. Further, the order in which different subassemblies should be opened often differs depending upon the location and type of paper jam. Lastly, in some complex systems, simple numbering of handles and levers is not sufficient to guide operators since the disassembly and reassembly of various components requires varying and complex operations. For instance, where subassemblies such as development apparatus are located on trays that can be accessed best after being slid out from the cabinet, it is important that trays that have been so moved be pushed entirely back into their proper location and secured in place before other components such as baffles and conveyance rollers are pressed back into position in contact with such removable tray.

For such complex systems requiring various sequences of operations depending upon the paper jam or other fault to be fixed and, further, requiring confirmation that particular steps in an operation be completed before subsequent steps are performed, its has become routine for operators to rely upon information displayed in the UI or other human interface to determine whether assembly or disassembly operations have been properly completed and, if so, which operations are to be performed next in the sequence. This often requires that an operator move back and forth between the UI and the cabinet or work space where the operations must be performed. The larger and more complex the equipment, the more important guidance from sensors within the system and cooperating control algorithms becomes. Also, the less trained the operators, the more reliant upon such instructions in a UI the operator becomes. For an equipment manufacturer, it is desired that machines be as easy to maintain as possible by customers in order to avoid service calls and to require as little operator time and training as possible.

Accordingly, it would be advantageous to have an apparatus and process that automatically guides an operator through various sequences for maintenance and repair without the need to continually refer to repair manuals or to human interfaces such as a systems UI. Such an automatic guide system would preferably allow an operator to remain in situ at the place of repair, maintenance or reassembly without needing to physically move or to change the focus of his/her attention. With such an automatic guide system, repair, maintenance, and assembly/reassembly processes should become more efficient and more reliable with decreased risk that an improper sequence will damage components, and require less training for human operators. A further advantage is that the present invention not only may be adapted to guide the sequence of operations but may, in addition, be adapted to direct movements or other manipulation of levers, latches, pulls, knobs, drawers, etc.

SUMMARY OF THE INVENTION

An apparatus requiring an operator to perform mechanical procedures upon the apparatus, such apparatus having parameters indicating apparatus status including fault parameters and nominal parameters, comprising: a controller for determining the sequence of procedures; a first human interpretable indicator, in communication with the controller and located proximate to an apparatus site where a procedure is to be performed; a second human interpretable indicator, in communication with the controller and located proximate to an apparatus site where a procedure is to be performed; a first sensor, associated with a first human interpretable indicator, for sensing an apparatus status parameter at the site proximate to the first human interpretable indicator, said first sensor communicating such parameter status to the controller; a second sensor, associated with a second human interpretable indicator, for sensing an apparatus status parameter at the site proximate to the second human interpretable indicator and for communicating such status to the controller; and a control algorithm used by the controller that, in response to a signal from the first sensor that a fault parameter exists, directs the controller to activate the first human interpretable indicator and, in response to a signal from the first sensor that a nominal parameter exists, inquiries the second sensor whether a fault parameter exists and, if such fault parameter exists, directs the controller to activate the second human interpretable indicator.

DETAILED DESCRIPTION OF THE DRAWINGS

While the present invention will hereinafter be described in connection with several embodiments and methods of use, it will be understood that this is not intended to limit the invention to these embodiments and methods of use. On the contrary, the following description is intended to cover all alternatives, modifications and equivalents, as may be included within the spirit and scope of the invention as defined by the appended claims.

Since one embodiment of the present invention is inclusion of an apparatus of the present invention in an electrophotographic printer, a description of the overall printing process with such a printer is now described. Inasmuch as the art of electrophotographic printing is well known, the various processing stations employed in the FIG. 9 printing machine will be shown hereinafter schematically and their operation described briefly with reference thereto.

Figure 9:
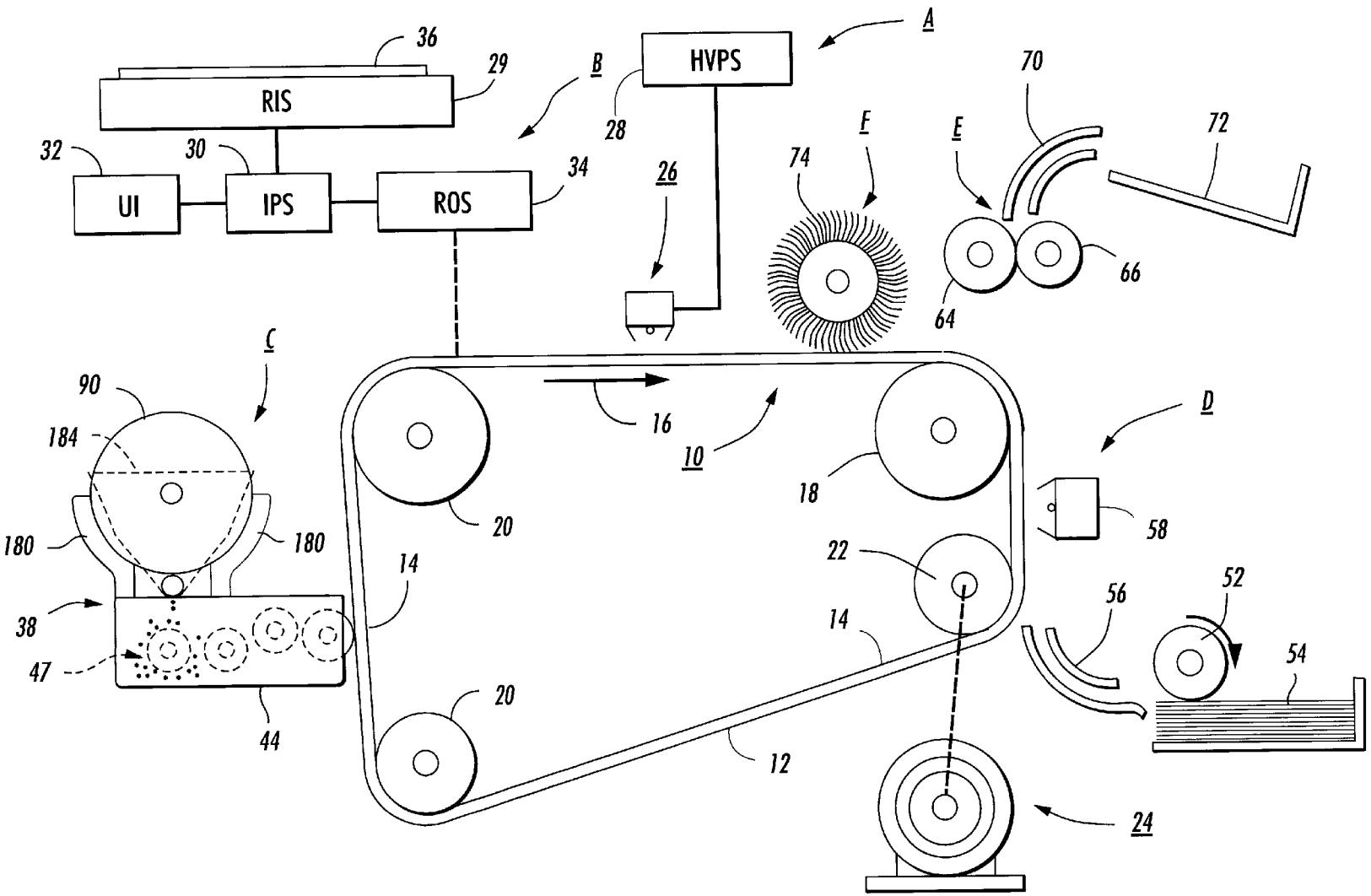
FIG. 9 is an elevated schematic description of an exemplary electrophotographic printer embodiment of the present invention.

Referring initially to FIG. 9, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 9. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 9, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Turning now to FIGS. 1–4, a sequence for clearing an exemplary paper jam is shown. As described above, not all paper jams will occur in the same locations or require the same sequence even for the same machine. In the example shown, sensors within the machine have detected a misfeed from copy sheet feeder apparatus 12. The machine has halted operation and informed the operator that a jam has occurred. The UI, not shown, schematically has informed the operator that the two main cabinet doors need to be opened. As described above, the controller and sensors have cooperated to determine which sheets undergoing processing can be processed through to completion and which must be halted along the sheet path.

Figure 1:
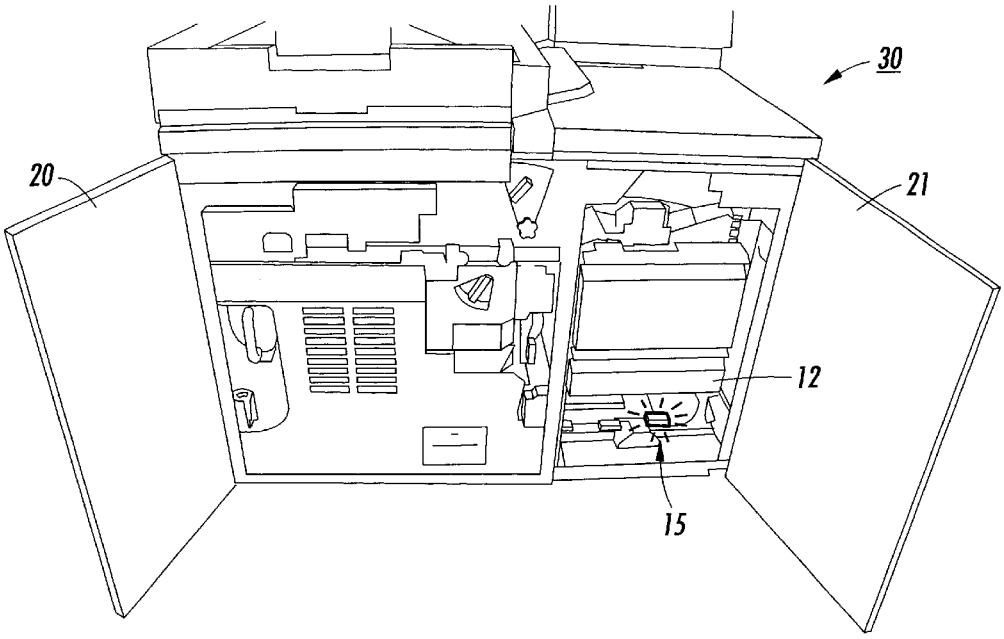
FIG. 1 is an elevated perspective view of an apparatus of the present invention showing illumination of one human interpretable indicator.

As the operator opens the two main cabinet doors, he sees the scene shown in FIG. 1. He cannot see the paper itself because the sheet path is buried behind various subassemblies and baffles. He also cannot know where the paper jam occurred or at which stations and subassemblies sheets have been stopped in situ. Under the prior art, the operator would typically have looked at the schematic presented in the UI to have a sense (but not certainty) where to look for paper to be removed. He may look for green or distinctive handles and levers If these are available. He then proceeds to clear one station and then look at the UI for information regarding another station to be cleared. In other words, he continues to look between the insides of the cabinet and the UI that is placed on top of the machine. At best this requires raising and lowering his head. More probably, he must raise and lower his body to first see the UI and then return to the cabinet to perform the next operation. Worse, there may be multiple sheets to be cleared at any one station. If he clears one sheet and moves on to the next station, then he may not know that one or more sheets were left behind until he believes he has completed the job, has closed the cabinet, stood upright, and then discovers that the UI is still indicating a paper jam somewhere in the equipment. As discussed above, in even more complex equipment having positioning clamps, levers, drawers that are pulled out and then pushed back into place, the operator may not know that the reassembly was incomplete until he closes the cabinet doors and is informed of a fault by the UI. Worse, delicate calibration and alignments between subassemblies may be disturbed if parts are clamped or otherwise placed under pressure when not completely reset in the proper position.

Accordingly, FIG. 1 shows an embodiment of the present invention where the operator opens the cabinet doors 20 and 21 of printer 30 and immediately sees an illuminated handle, lever, or other disassembly fixture 15. Such illumination 15 may be by a switched incandescent or fluorescent light bulb or, preferably, illumination by such means as LEDs embedded into the disassembly fixture itself. It is possible that indicators other than illumination will work, such as sound or blinking lights, but the invention will be explained using illumination as the user indicator. Such illumination immediately draws the operator's attention to disassembly fixture 15 and informs the operator which step is to be performed first. He does not need to guess which procedure to implement first nor which disassembly fixture will implement the chosen disassembly procedure.

Figure 2:
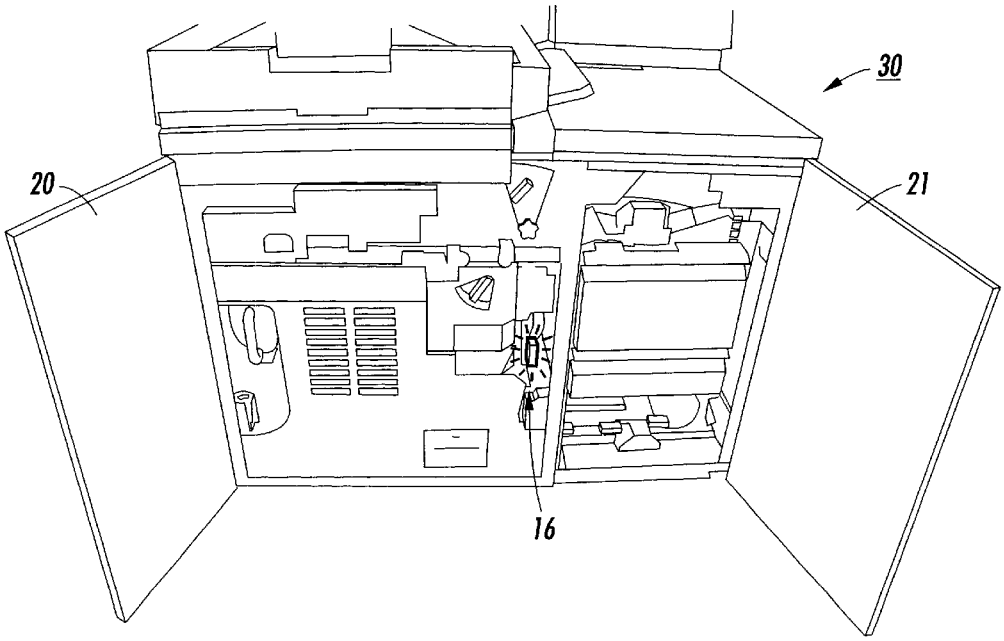
FIG. 2 is an elevated perspective view of an apparatus of the present invention showing illumination of a second human interpretable indicator.

Advantageously, when the operator has correctly completed the first step, the illumination at fixture 15 ceases and, as shown in FIG. 2, an other illumination draws the operators attention to fixture 16. Importantly, illumination of fixture 15 will not cease and illumination at fixture 16 will not commence until the work at fixture 15 is correctly completed. Thus, if the operator has removed one sheet from the copy feeder assembly 12 and, in fact, two or more sheets need to be cleared, then fixture 15 remains illuminated even after the operator returns any moved parts back to their operational position. Equally important, if some component had been moved during the operation at fixture 15 but had not been returned to its proper position, then fixture 15 would remain illuminated, and the operator would know that something needed correction.

When contrasting the above to the prior art, it is clear that continual reference to the UI for instructions has been essentially eliminated, and the operator can remain focused on the equipment in front of him rather than needing to focus on multiple locations. In other words, once the UI refers the user to the cabinet doors, this transitions the user's attention from the UI itself to the illuminated handles. The handles become the user's interface with the machine until the jam is cleared, at which point, the user transitions back to the UI. Also, the operator gets immediate feedback whether the disassembly and reassembly has been performed correctly. The likelihood of damaged components due to failure to reassembly in the correct order or location has been greatly reduced or eliminated. Lastly, an operator will not experience the situation of believing that the repair has been finished with the cabinets closed only to find that some operation or procedure has been missed.

Returning to FIG. 2, the operator's attention is drawn to illuminated fixture 16. As above, the present invention provides the operator confidence that procedures at fixture 15 have been completed successfully. By illumination at fixture 16, the operator need not guess which operation to perform next or which fixture to manipulate in order to perform the procedure.

Figure 3:
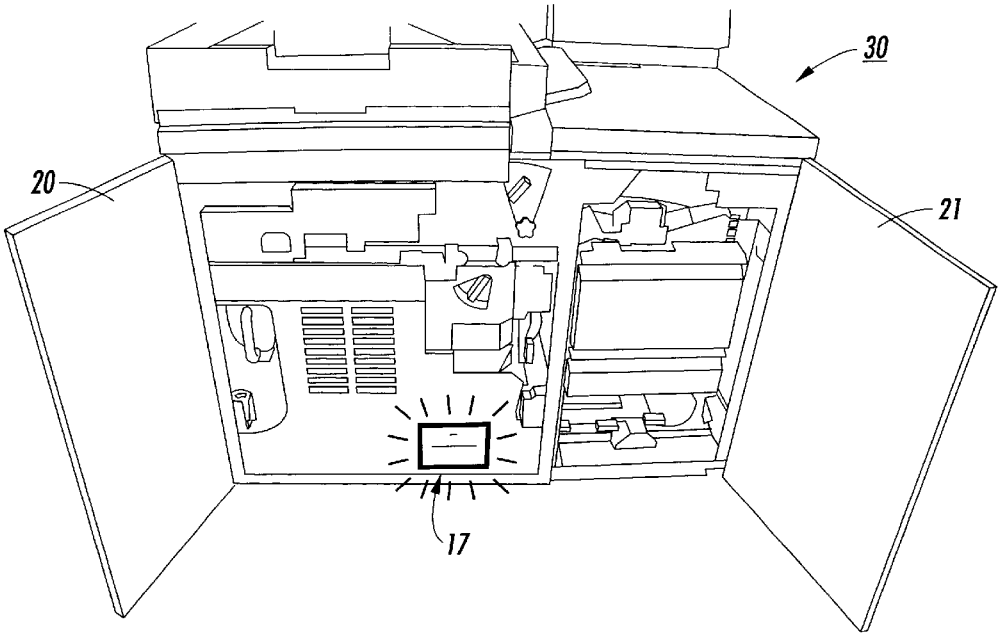
FIG. 3 is an elevated perspective view of an apparatus of the present invention showing illumination of a third human interpretable indicator.
Figure 4:
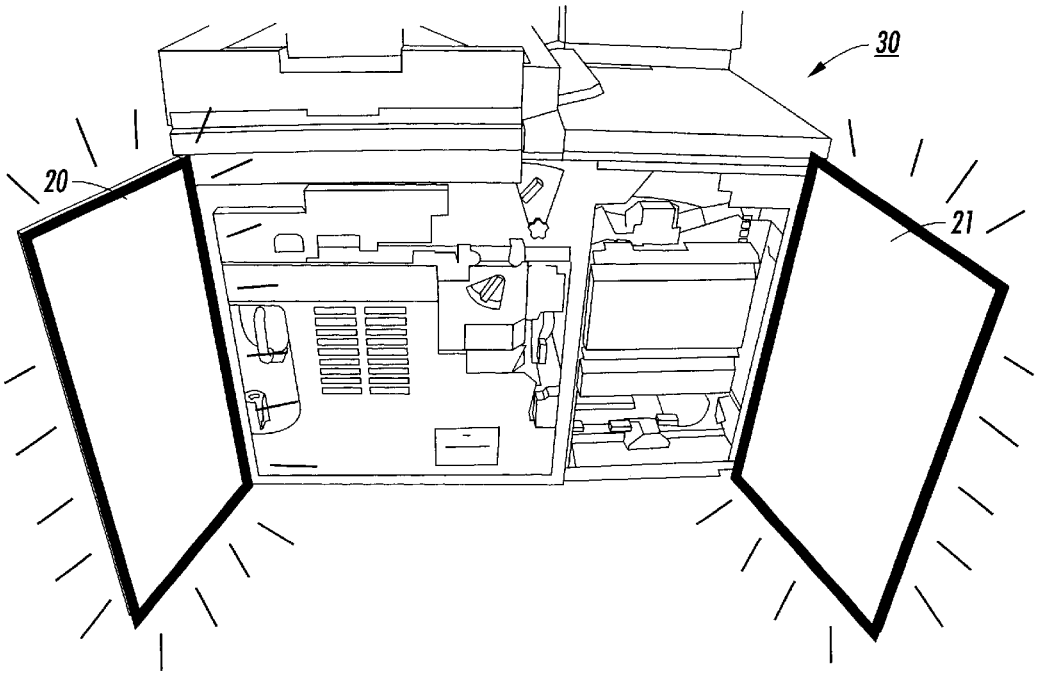
FIG. 4 is an elevated perspective view of an apparatus of the present invention showing illumination of a fourth human interpretable indicator placed on cabinet doors.

Turning to FIG. 3, the operator observes that fixture 16 is no longer illuminated, and his attention is immediately drawn to the newly illuminated fixture 17. As described above, this switch in illumination conveys valuable information, including that the preceding operation was completely thoroughly and correctly. Upon completing the operation at fixture 17, the operator will observe that illumination has moved to cabinet doors 20 and 21. In addition to informing the operator that the operations at fixture 17 have been completed and correctly performed, illumination at the cabinet doors informs the operator that the repair has been completed. In this case, illumination of the doors indicates that the sheets jammed in the printer have all been removed. Of course, any type of overall completion indicator could be employed, including sound emitters or lights at a different location than the cabinet doors. Whichever completion indicator is used, however, the operator knows that he does not need to continue searching for more jammed paper and need not disturb other portions of the apparatus. In the long term, such minimization of effort both increases operator efficiency and preserves wear and tear on equipment and parts. Also, minimal disturbance of components helps preserve calibration and tolerances within the machine.

It will be understood that the more complex the apparatus to be operated upon, the more valuable the present invention will generally become. Particularly with systems such as printers that often require simple maintenance and monitoring by minimally trained operators, the present invention makes such maintenance more efficient and more likely to succeed while minimizing the opportunity for damage to the components.

Figure 5:
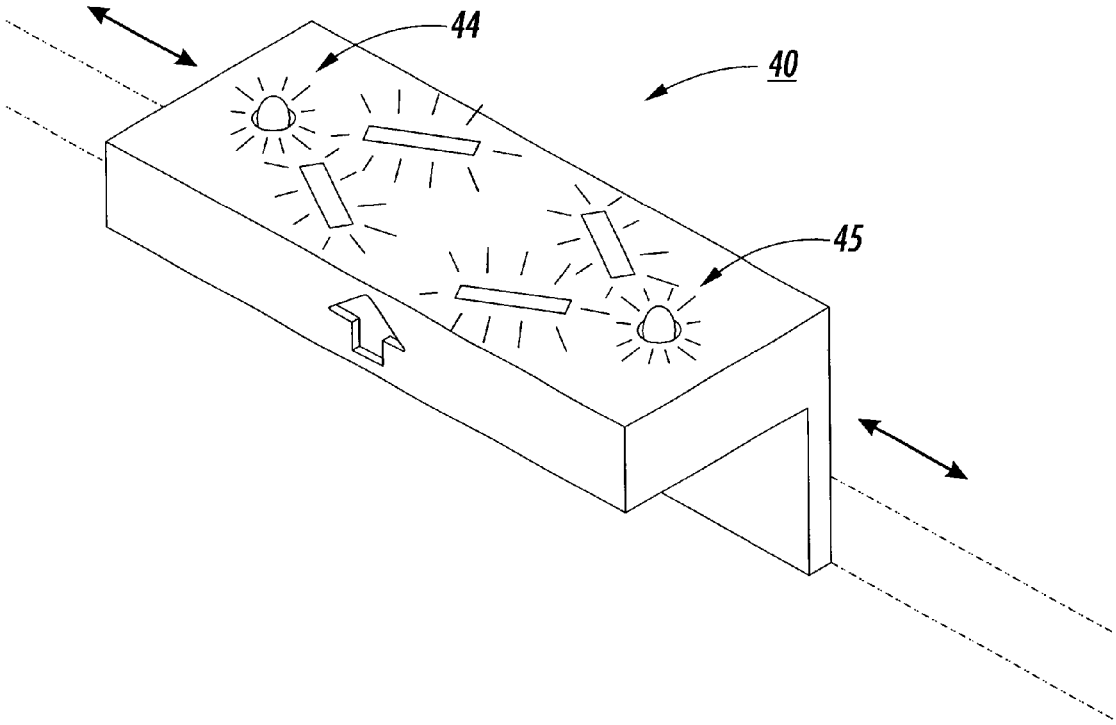
FIG. 5 is an elevated perspective view of an assembly/reassembly fixture of an apparatus of the present invention showing human interpretable indicators capable of conveying greater status information and manipulation information.

Turning now to FIG. 5, close-up perspective view shows several additional embodiments of the present invention. Specifically, handle 40 is a grip handle to enable an operator to slide a portion of a subassembly in the direction of arrow 41 in order to obtain access to a jammed sheet. As shown, handle 40 has two sets of illuminators. LEDs 44 and 45 are colored red and green, respectively. As long as the controller senses a sheet at the location of handle 40, the red light remains lit. The operator knows that all sheets accessible by handle 40 have been removed when the red LED is dimmed and the green light is lit. This variation on the present invention provides the operator with even more information since he does not need to return handle 40 to its operating position without knowing with certainty that all sheets have been removed that should be removed. Without this feature, the operator will not progress to the next station under the present invention but he may open and close handle 40 multiple times until the LEDs on handle 40 are extinguished and the next set of illuminators light up.

A second feature revealed in FIG. 5 is a directional signal formed by LED lights. These indicate to an operator which direction the handle is to be moved for the correct operation. For untrained operators dealing with complex machines, indicators that direct movement in one direction for opening and the opposite for closing greatly simply instructions and provide more certainty. As shown in FIG. 5, direction can be indicated by a pattern of lights. Alternatively, LEDs could blink in a sequence that the human eye perceives to be leading in one direction or the other.

Figure 6:
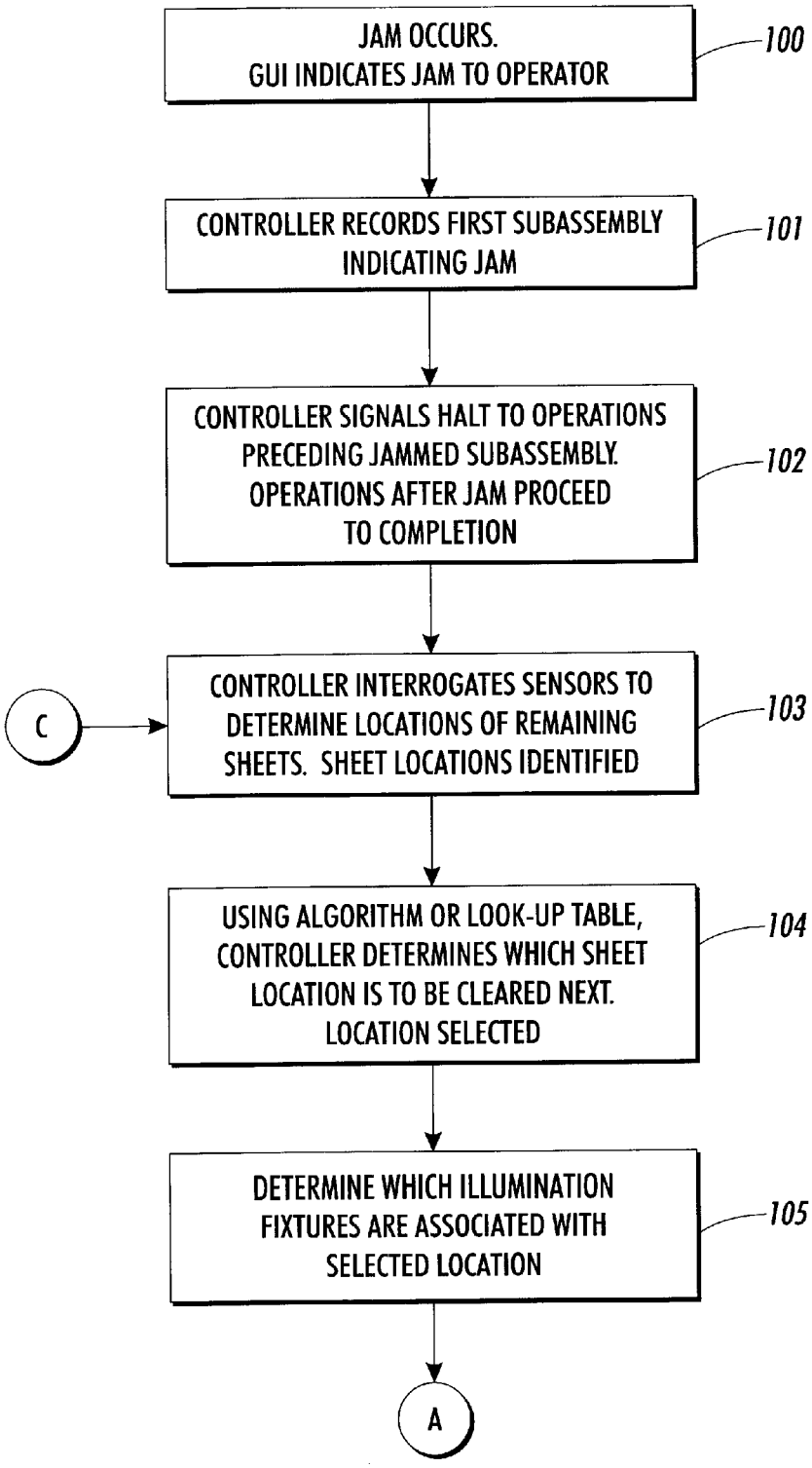
FIG. 6 is the first portion of a logical sequence depicting a process embodiment of the present invention.
Figure 7:
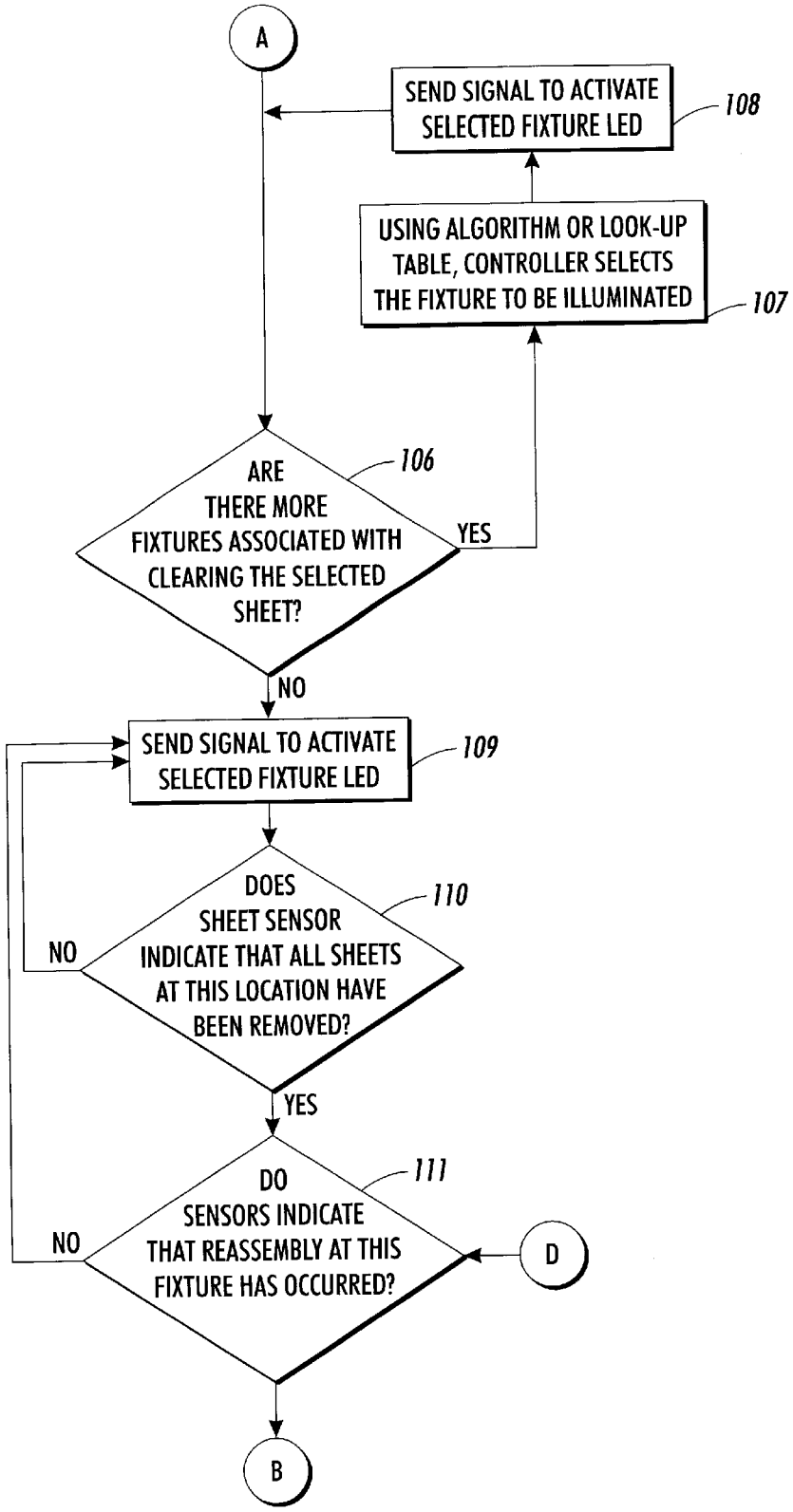
FIG. 7 is a second portion of a logical sequence depicting a process embodiment of the present invention.
Figure 8:
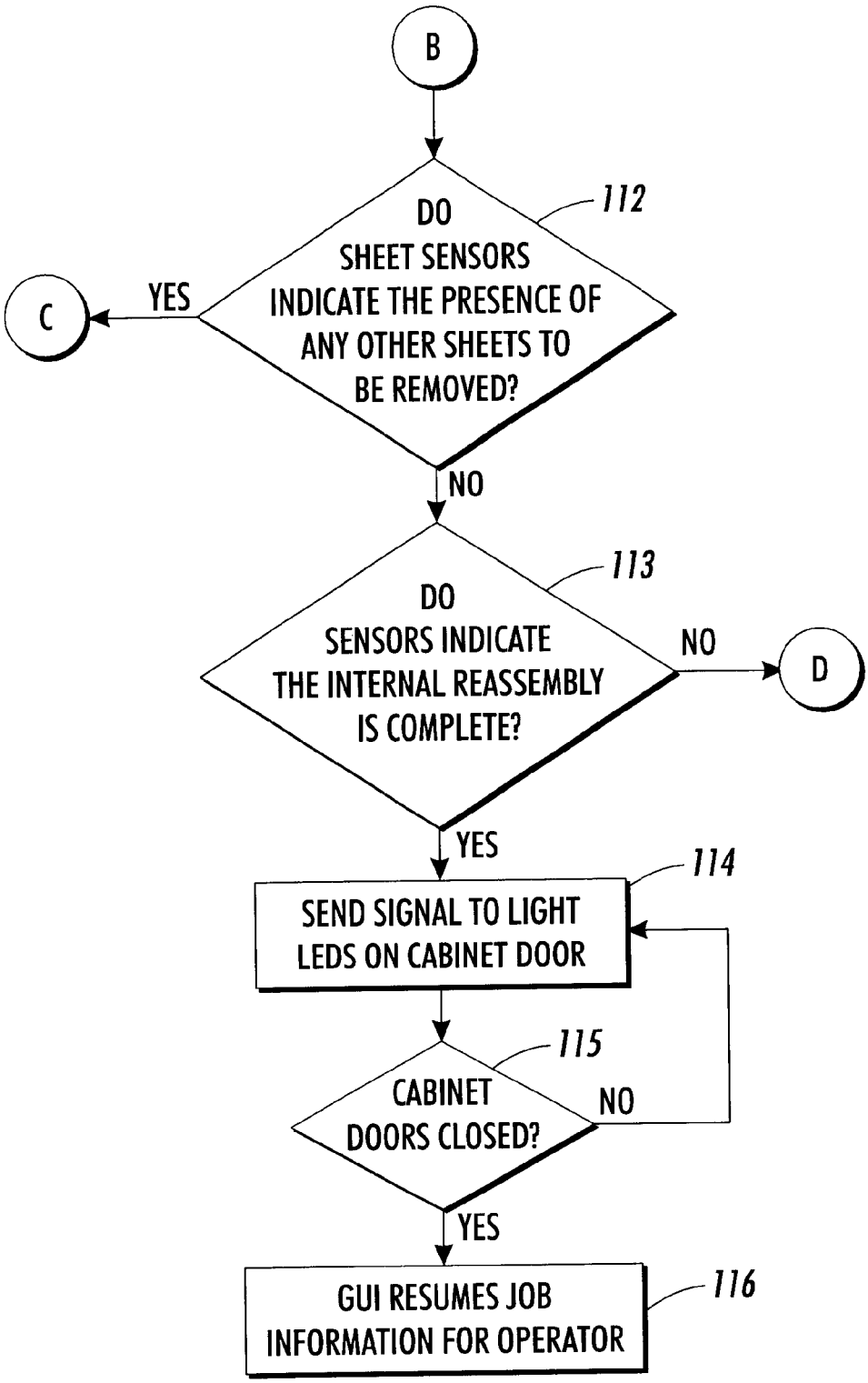
FIG. 8 is a third portion of a logical sequence depicting a process embodiment of the present invention.

Turning now to FIG. 6, the interplay between sensors, controllers, algorithms and illuminators of the present invention will be described. As above, an embodiment of the present invention will be described in relation to a paper jam within an electrophotographic printer. This embodiment is exemplary only and may be generalized to any number of other situations and equipment.

At step 100, a jam has occurred. At step 101 the controller enters into its fault detection subroutines, which in this case deduces that the first subassembly within the system to seize or otherwise indicate a jam must be the location where the first jam occurs. At 102, the controller signals a halt to operations that involve sheets preceding the jammed subassembly in the sheet path. Operations involving sheets in front of the jam are allowed to proceed. This feature is taught and more fully set forth in Schron and Bloom, discussed earlier. At 103, the controller interrogates sensors determine the locations of sheets remaining after the Schron and Bloom-type processing has continued. At 104, using algorithms or look-up tables corresponding to the locations where sheets remain stuck in the system, the controller determines which location is to be cleared next. This sheet location is selected for clearance first. At 105, the controller determines which disassembly fixtures are associated with the selected Sheet location. At 106, the controller typically refers to a look-up table to determine whether the selected sheet location requires one or a plurality of disassembly operations to obtain access to the selected sheet. If yes, then at 107 the controller again refers to a look-up table or algorithm to determine which of the several disassembly fixtures should be selected for the initial disassembly operation for that sheet location. This type of selection is frequently required when multiple baffles or tension-inducing members must be loosened in order to obtain access. For repairs in an electrophotographic engine such as changing a photoreceptor belt, many separate disassembly operations may be necessary such as above, and each operation may preferably have its own disassembly fixture.

Returning to step 107, once the controller has selected the appropriate disassembly fixture, then, at 108, a signal is sent to activate the LEDs associated with such fixture. Since there are multiple fixtures associated with this sheet location, the algorithm returns to step 106 where the loop 106–108 is repeated until all disassembly operations at the selected sheet location are completed. When all but the last such disassembly operation at that sheet location is completed, then the controller algorithm proceeds to step 109 where a signal is sent to the last fixture at that location for the LEDs to light.

It should be noted that signals for steps 108, 109, or other steps can be sent in any number of ways. Sensors and LEDs can obviously be wired for conventional electrical signals. Another embodiment is to minimize wiring within the system by sending such signals through Radio Frequency (RF) transmitters and receivers. Such RF technology is now relatively inexpensive and readily available on EEPROMs and similar semiconductor chips. One additional advantage of using RF signals is that machines produced or initially designed without the present invention can be retrofitted without introducing a major new set of wires. All that is required is a means for supplying power to LEDs, and such power can be tapped from wires carrying power near the LED sites or may even be supplied by batteries that would need to be replaced periodically.

Returning to step 110, the controller interrogates the sheet sensors whether all sheets at this location have been removed. As described above, this step is a major advantage of the present invention since under the prior art, the operator may not realize that multiple sheets at this location are to be removed. The operator may thus remove one sheet and proceed to reassemble the entire machine only to find later that additional sheets are still buried somewhere in the apparatus. The inquiry of step 110 may be sequenced on a timed manner, e.g., every 2 seconds, or may be triggered by some other event such as a change in signals sent from the sheet sensors. If the answer to the inquiry in 110 is negative, then the controller returns to step 109, and the iteration between 110 and 109 continues until all sheet sensors at this location indicate sheet clearance. As noted in relation to FIG. 5, an additional embodiment of the present invention is to have two separate LED indicators at each disassembly fixture. When all sheet sensors indicate clearance, then the LEDs switch from red to green, for example, so that the operator knows that all sheets are cleared and he may proceed to the next step.

With or without such sheet clearance embodiment, completion of step 110 enables the controller to proceed to step 111. In the embodiment shown in this example, reassembly at the sheet location occurs as soon as sheets at that location have been cleared. It is also possible for some maintenance and repair operations that reassembly would not occur until later in the process, and step 111 may be moved to a later stage of the process. Regardless where placed, at step 111, the controller interrogates sensors, that may be electrical contacts in latches, pressure sensors, etc, whether the reassembly at the selected sheet location has been completed. If not, then the operator continues to see that he has work to perform at that location since the controller returns to step 109 until it receives confirmation of successful reassembly. If the sheet clearance indicators of FIG. 5 have been installed, then the operator knows that the reassembly is faulty since he has received a sheet clearance confirmation. Even without this embodiment, the operator knows that something is still faulty at this location, and he again reopens the assembly, looks for additional sheets, and attempts the reassembly. As noted above, this step saves a great amount of time because the operator knows not to proceed until the LEDs at this location have dimmed.

Once the controller senses that step 111 is complete, then the applicable LEDs that location dim and the controller proceeds to step 112. At 112, the controller again interrogates the various sheet sensors to determine if additional sheets must be removed. If sensors in other locations indicate such a presence of additional sheets (which is the normal occurrence for most sheet jams), then the controller returns to step 103 and the process will be repeated.

For the operator, the great advantage is that a new set of LEDs light up another disassembly fixture, and the operator need not stand up to look at the UI nor wonder which step he should perform next. The controller, in effect, has removed doubt and made informed decisions for the operator. Also, as noted above, the operator need not perform unnecessary relating to sheets that were not jammed and were, instead, processed to completion. This ability to save operator disassembly steps saves time, effort, and minimized the wear and tear on machine components since fewer will be jostled, moved, etc.

Once the controller completes step 112 and confirms that all sheets have been removed, it proceeds to step 113 where it seeks to reconfirm that all reassembly operations have been performed correctly. If a reassembly sensor indicates that a subassembly needs readjustment, etc, then the controller returns to step 111. If all reassembly sensors check out correctly, then the controller proceeds to step 114. At 114, the LEDs associated with the cabinet doors light. This is the signal to the operator that the sheet jam process has essentially been completed. Again, the operator is saved from needing to change posture to look at the UI and is also saved from believing that he has completed the process only to find when he again stands to operate the machine that the doors must be opened again and some operation must be repeated.

At step 115, the controller inquiries whether the doors have been properly closed. This is similar to other reassembly steps in 111 and 113 and may rely upon electrical connections in latches, pressure sensors, etc. Once an affirmative signal has been sent, then the paper jam subroutine software in the controller is exited by the controller. The software controlling performance eof the print job is resumed, and the UI once again presents to the operator information relating to job processing rather than maintenance or repair.

In sum, a process using the present invention has been presented where an exemplary routine maintenance procedure such as a paper jam has been used to illustrate the advantages and efficiencies of the apparatus of the present invention. Although the applicability of the present invention to paper jam removal has been shown, similar processes may be advantageously used for any number of repair and maintenance functions on complex hardware. It should also be noted that the same LED lights and fixtures may be used for multiple types of operations. For instance, if a photoreceptor belt required replacement in an electrophotographic printer, then a different software program than shown above would be accessed by the control mechanisms for the printer. This photoreceptor replacement software may have many of the same steps as shown above but may utilize different disassembly fixtures and a different chronological order of operations. Thus, the present invention and the processes associated therewith offer great flexibility even within the same hardware system. For each different type of procedure, different software can be accessed and different procedures can be directed by the indicators of the present invention. As shown above, another advantage is that even the same type of operation, such as a paper jam, may favorably be directed differently depending upon the specific circumstances of each occurrence. The processes and apparatus of the present invention permit a wide degree of flexibility that increase efficiency, requires less training for operators, less physical effort by operators, and less wear and tear on the apparatus itself.

It is, therefore, evident that there has been provided in accordance with the present invention an apparatus and method that fully satisfies the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus having a fault condition requiring procedures to be performed at a plurality of apparatus sites and having parameters indicating apparatus status including fault parameters and nominal parameters, comprising:

a. a first human interpretable indicator located proximate to a first apparatus site where a procedure is to be performed;

b. a second human interpretable indicator located proximate to a second apparatus site where a procedure is to be performed;

c. a first sensor, associated with the first human interpretable indicator, for sensing an apparatus status parameter at the site proximate to the first human interpretable indicator;

d. a second sensor, associated with the second human interpretable indicator, for sensing an apparatus status parameter at the site proximate to the second human interpretable indicator; and e. a controller for determining a sequence of procedures, said controller communicating with the first and second human interpretable indicators and the first and second sensors wherein, in response to a signal from the first sensor that a fault parameter exists, directs activation of the first human interpretable indicator and, in response to a signal from the first sensor that a nominal parameter exists, inquiries the second sensor whether a fault parameter exists and, if such fault parameter exists, directs activation of the second human interpretable indicator.

2. The apparatus of claim 1, wherein the second human interpretable indicator is not activated until the first sensor indicates that a nominal parameter exists and, upon such signal from the first sensor, the first human interpretable indicator is inactivated.

3. The apparatus of claim 1, wherein a transition from a fault parameter to a nominal parameter indicates that the procedure at the site of the first human interpretable indicator has been completed successfully.

4. The apparatus of claim 1, further comprising:

a. a third human interpretable indicator, in communication with the controller and located proximate to an apparatus site where a third procedure is to be performed;

b. a third sensor, associated with the third human interpretable indicator, for sensing an apparatus status parameter at the site proximate to the third human interpretable indicator and for communicating such status to the controller;

wherein, in response to a signal from the second sensor that a nominal parameter exists, inquiries the third sensor whether a fault parameter exists and, if such fault parameter exists, directs activation of the third human interpretable indicator.

5. The apparatus of claim 1, wherein the apparatus comprises an electrophotographic reprographic system.

6. The apparatus of claim 5, wherein at least one sensor senses whether a sheet is jammed within the system.

7. The apparatus of claim 5, wherein a series of sensors sense the locations of various sheets situated within the system after the system shuts down normal operations.

8. The apparatus of claim 1, wherein the apparatus is at least a portion of a vehicle.

9. The apparatus of claim 1, further comprising a graphic user interface that indicates the existence of at least one fault parameter within the apparatus.

10. The apparatus of claim 9, wherein the graphic user interface further indicates the general area within the apparatus wherein at least one fault parameter is sensed.

11. The apparatus of claim 1, wherein at least one human interpretable indicator comprises a source of illumination.

12. The apparatus of claim 11, wherein the source of illumination further comprises a source of a first color illumination indicating the sensing of a fault parameter and a second color illumination indicating the sensing of a nominal parameter.

13. The apparatus of claim 1, wherein at least one human interpretable indicator comprises an indicator of a direction in which a component should be moved.

14. The apparatus of claim 13, wherein the human interpretable indicator comprises a plurality of sources of illumination activated in sequence.

15. An apparatus having procedures to be performed at at least one apparatus site and having parameters indicating apparatus status including fault parameters and nominal parameters, comprising:

a. a first human interpretable indicator located proximate to a first apparatus site where a procedure is to be performed;

b. a second human interpretable indicator located proximate to a second apparatus site where a procedure is to be performed;

c. a first sensor, associated with the first human interpretable indicator, for sensing an apparatus status parameter at the site proximate to the first human interpretable indicator;

d. a second sensor, associated with the second human interpretable indicator, for sensing an apparatus status parameter at the site proximate to the second human interpretable indicator;

e. a last of a series of human interpretable indicators wherein activation of said last human interpretable indicator indicates that all sensors associated with other human interpretable indicators within the series are communicating that nominal parameters are sensed; and f. a controller for determining a sequence of procedures, said controller communicating with the first and second human interpretable indicators and the first and second sensors wherein, in response to a signal from the first sensor that a fault parameter exists, directs activation of the first human interpretable indicator and, in response to a signal from the first sensor that a nominal parameter exists, inquiries the second sensor whether a fault parameter exists and, if such fault parameter exists, directs activation of the second human interpretable indicator.

16. The apparatus of claim 15, wherein said last human interpretable indicator is associated with a cabinet door.

17. An electrophotographic reprographic system having a fault condition requiring procedures to be performed at a plurality of system sites and having sensor parameters indicating system status including fault parameters and nominal parameters, said system comprising:

a. a first human interpretable indicator located proximate to a site within the system where a procedure is to be performed;

c. a second human interpretable indicator located proximate to a site within the system where a second procedure is to be performed;

d. a first sensor, associated with the first human interpretable indicator, for sensing a system status parameter at the site proximate to the first human interpretable indicator;

e. a second sensor, associated with the second human interpretable indicator, for sensing a system status parameter at the site proximate to the second human interpretable indicator; and f. a controller for determining a sequence of procedures, said controller communicating with the first and second human interpretable indicators and with the first and second sensors wherein, in response to a signal from the first sensor that a fault parameter exists, the controller directs activation of the first human interpretable indicator and, in response to a signal from the first sensor that a nominal parameter exists, the controller inquiries the second sensor whether a fault parameter exists and, if such fault parameter exists, directs activation of the second human interpretable indicator.

18. The system of claim 17, wherein at least one sensor senses whether a sheet is jammed within the system.

19. The apparatus of claim 17, wherein a series of sensors sense the locations of various sheets situated within the system after the system shuts down normal operations.

20. A process for guiding human operator procedures for an apparatus having a fault condition requiring procedures to be performed at a plurality of apparatus sites and having parameters indicating apparatus status including fault parameters and nominal parameters, said process comprising:

a. sensing a fault parameter by a first sensor at a first parameter site;

b. activating a first human interpretable indicator proximate to the first parameter site sensed by the first sensor;

c. in response to sensing a nominal parameter at the first sensor, interrogating a second sensor at a second parameter site to determine whether a fault parameter is sensed by the second sensor; and d. in response to sensing a fault parameter by the second sensor, activating a second human interpretable indicator proximate to the parameter site sensed by the second sensor.

21. The process of claim 20, wherein the step of activating the second human interpretable indicator occurs after the first sensor indicates that a nominal parameter exists, and further comprising, upon sensing a nominal parameter by the first sensor, deactivating the first human interpretable indicator.

22. The process of claim 20, further comprising, in response to sensing a nominal parameter at the second sensor, interrogating a third sensor at a third sensor site to determine whether a fault parameter is sensed by the third sensor; and, in response to sensing a fault parameter by the third sensor, activating a third human interpretable indicator proximate to the parameter site sensed by the third sensor.

23. The process of claim 20, further comprising interrogating a series of sensors to determine the location of a plurality of fault parameters within the apparatus.

24. The process of claim 23, further comprising determining which of a plurality of fault parameter sites should be operated upon next.

25. The process of claim 20, further comprising:

a. determining whether the site of the fault parameter sensed by the first sensor requires a plurality of procedures associated with that site in order to restore nominal parameters;

b. in response to determining that a plurality of procedures are required, selecting the procedure to be performed next; and c. activating the human interpretable indicator associated with said next procedure.

26. The process of claim 20, wherein the fault parameter sensed by at least one sensor indicates that a sheet has jammed at the sensed parameter site.

27. The process of claim 26, further comprising interrogating a series of sensors to determine the locations of sheets within the apparatus.

28. The process of claim 26, further comprising directing the apparatus to complete operations upon sheets preceding the jammed sheet and to halt operations upon sheets that trail the jammed sheet.

29. A process for guiding human operator procedures for an apparatus having parameters indicating apparatus status including fault parameters and nominal parameters, said process comprising:

a. sensing a fault parameter by a first sensor at a first parameter site;

b. activating a first human interpretable indicator proximate to the first parameter site sensed by the first sensor;

c. in response to sensing a nominal parameter at the first sensor, interrogating a second sensor at a second parameter site to determine whether a fault parameter is sensed by the second sensor; and d. in response to sensing a fault parameter by the second sensor, activating a second human interpretable indicator proximate to the parameter site sensed by the second sensor;

e. in response to sensing nominal parameters at all sites at which fault parameters were initially sensed, activating a last human interpretable indicator to indicate restoration of nominal parameters at such sites.

* * * * *